United States Patent [19]

Gunn et al.

[11] Patent Number: 4,500,610

[45] Date of Patent: Feb. 19, 1985

[54] CORROSION RESISTANT SUBSTRATE WITH METALLIC UNDERCOAT AND CHROMIUM TOPCOAT

[76] Inventors: Walter H. Gunn, 45 Virginia Dr., Painesville, Ohio 44077; Alexander W. Kennedy, 11857 Auburn Rd., Chardon, Ohio 44024

[21] Appl. No.: 475,734

[22] Filed: Mar. 16, 1983

[51] Int. Cl.[3] ..... C25D 5/10

[52] U.S. Cl. ..... 428/624; 428/621; 428/632; 428/557; 428/658; 428/328; 204/28; 204/40; 204/407; 148/6.2

[58] Field of Search ..... 428/624, 328, 621, 632; 204/28, 40, 407; 148/62

[56] References Cited

U.S. PATENT DOCUMENTS

| | | | |
|---|---|---|---|
| 2,419,231 | 4/1947 | Schantz | 428/658 |
| 3,420,754 | 1/1969 | Roehl | 204/28 |
| 3,671,331 | 6/1972 | Malkin et al. | 428/557 |
| 3,687,739 | 8/1972 | Kennedy et al. | 428/564 |
| 4,079,163 | 3/1978 | Tanaka et al. | 428/328 |
| 4,216,272 | 8/1980 | Clauss | 428/632 |
| 4,282,073 | 8/1981 | Hirt et al. | 204/28 |
| 4,314,893 | 2/1982 | Clauss | 204/40 |
| 4,351,713 | 9/1932 | Hirt et al. | 204/207 |
| 4,374,902 | 2/1983 | Smith et al. | 428/621 |
| 4,388,160 | 6/1983 | Rynne | 204/38 R |

FOREIGN PATENT DOCUMENTS

| | | |
|---|---|---|
| DE3300543A | 7/1983 | Fed. Rep. of Germany . |
| 46-63416 | 4/1971 | Japan . |
| 55-16349 | 2/1980 | Japan . |
| 110729 | 8/1980 | Japan . |
| 55-158262 | 12/1980 | Japan . |
| 56-113387 | of 1981 | Japan . |
| 6020190 | 2/1981 | Japan . |
| 57-174469 | 4/1981 | Japan . |
| 98216 | 6/1981 | Japan . |
| 56-130477 | 10/1981 | Japan . |
| 7207199 | 12/1982 | Japan . |
| 58-310096 | 2/1983 | Japan . |
| 8019492 | 2/1983 | Japan . |

*Primary Examiner*—Veronica O'Keefe
*Attorney, Agent, or Firm*—John J. Freer

[57] ABSTRACT

A coating composite provides extended corrosion resistance for substrate metals. The thin metallic undercoat of the composite contains combined metals. The heat curable and substantially resin free topcoat is established from composition containing chromium in non-elemental form, which topcoat composition may further contain particulate metal, all in liquid medium. In addition to outstanding corrosion resistance, the composite can retain substrate weldability and formability, while further enhancing paintability and weatherability.

33 Claims, No Drawings

CORROSION RESISTANT SUBSTRATE WITH METALLIC UNDERCOAT AND CHROMIUM TOPCOAT

BACKGROUND OF THE INVENTION

The tendencies of iron or steel surfaces to corrode is well known. Zinc is one of the most widely used metallic coatings applied to steel surfaces to protect them from corrosion. In the past, the principal methods of applying such coatings were hot-dipping. also known as galvanizing and the electroplating of a zinc layer onto the steel. Zinc has been electroplated on the steel surfaces from various plating baths, preferably from acid plating baths, for providing protection of steel surfaces for various uses.

It has been known as in the U.S. Pat. No. 2,419,231 to improve the corrosion resistance of the coating layer by using for the coating an alloy high in zinc and low in nickel. This alloy is co-deposited from the electrolytic plating bath onto the steel substrate. Continuous steel strip, alloy-plated in accordance with the teachings of the patent, when subjected to forming and finishing operations, tends to form cracks in the coating because of the brittleness of the alloy. However, subsequent improvements, as in U.S. Pat. No. 3,420,754 teaching an improvement in corrosion resistance by a slight increase in the nickel content of the deposited alloy, have been forthcoming. Moreover, improvements in electroplate uniformity and further corrosion improvement by nickel priming have been accomplished as disclosed in U.S. Pat. No. 4,282,073.

Also, as an after-treatment, the electroplated surface can be subjected to a chromate rinse, such as disclosed in Japanese Patent Disclosure No. Showa 55-110792. In some cases with substrates protected with alloyed zinc-plated layers it has been proposed to subsequently treat the surface with a chromate conversion coating, as has been shown in Japanese Patent Disclosure No. Showa 57-174469. However, as in all matters pertaining to corrosion-resistance, applications which lengthen the corrosion-resistance of the coated substrate can be a desirable improvement.

It has also been known to protect steel surfaces against corrosion by using coating compositions that contain a hexavalent-chromium-providing substance as well as further containing a finely divided metal. For example, U.S. Pat. No. 3,687,739 discloses the preparation of a treated metal surface wherein such treatment includes application of a composition containing, among other constituents but as critical ingredients, chromic acid and a particulate metal. As has been disclosed in U.S. Pat. No. 3,671,331 the metals of the substrate for protection are advantageously metals from copper through zinc, inclusive, on the electromotive force series, as well as alloys of such metals wherein such metals are present in major amount. After the chromium containing bonding compositions are applied to such metal substrate, they are most always topcoated with a weldable primer topcoat composition. Such topcoats may then be cured by elevated temperature baking. It has also been known to coat zinc plated steel, typically in sheet form, with weldable zinc rich primers. Thus, in U.S. Pat. No. 4,079,163 it is shown to coat weldable primer over chromate treated galvanized steel.

It would however be further desirable to protect ferrous metals in corrosive environments, by extending even further the corrosion resistance by coating technique. It would be also desirable to provide the resulting coated article with a wide variety of worthwhile characteristics. Exemplary of these would be coating adhesion during metal forming operation, plus retention of weldability where the coated substrate would otherwise be weldable. It would be well to be able to provide coating compositions and procedures tailored to fast, economical operations, especially for the coating of steel in coil form, so as to provide an enhanced product for the automotive industry quickly and economically.

SUMMARY OF THE INVENTION

It has been found possible to provide coated metal substrates with outstanding corrosion resistance. Furthermore, coating characteristics are not diminished. Rather, shear adhesion of the coating to the substrate metal can be enhanced. In addition to outstanding corrosion resistance, the composite can retain substrate weldability and formability, while further enhancing paintability and weatherability. Moreover, with newly developed high-strength, low-alloy steels, such characteristics are achieved in energy-efficient, low-temperature coating operation which are not deleterious to the inherent strain characteristics of the substrate metal. The resulting article, e.g., continuously annealed and coated steel with enhanced resistance to corrosion attack as well as further desirable characteristics, e.g., weldability and formability, can be achieved in fast, economical operation and is of particular interest for automotive use.

In one aspect, the present invention is directed to a coated metal substrate having enhanced corrosion resistance and protected by a coating composite comprising a thin metallic undercoating layer containing zinc and nickel in alloy form and a heat curable, substantially resin free topcoat layer from composition curable to a water resistant protective coating. The topcoat layer contains above 10 milligrams per square foot of coated substrate of chromium, as chromium, in non-elemental form, with the composition containing hexavalent-chromium-providing substance in liquid medium.

In its broadest aspect, the invention is directed to such coated metal substrates wherein the thin metallic undercoating layer is of combined metals in metallic form at least one of which is selected from the group consisting of zinc, nickel, iron, chromium, aluminum and cobalt. Another aspect of the invention includes a method of preparing a coated metal substrate protected with a coating composite providing enhanced corrosion resistance.

DESCRIPTION OF THE PREFERRED EMBODIMENTS

The metal substrates contemplated by the present invention are exemplified by any of the metal substrates to which a combination metallic coating can be applied. For example, such metal substrates may be aluminum and its alloys, zinc and its alloys, copper and cupriferous, e.g., brass and bronze. Additionally, exemplary metal substrates include cadmium, titanium, nickel, and its alloys, tin, lead, chromium, magnesium and alloys thereof, and for weldability, preferably a ferrous metal substrate such as iron, stainless steel, or steel such as cold rolled steel or hot rolled and pickled steel. All of these for convenience are usually referred to herein simply as the "substrate."

Such substrate may first receive a pretreatment before undercoating. For example, a thin metallic nickel pretreatment, or nickel "strike" layer, such as on the order of about one micron thickness or so, may be deposited before a nickel/zinc alloy coating. Or a copper pretreatment or "flash" coating layer can precede the electroplating of a zinc alloy. Other metallic pretreatments can include cobalt and tin. Such metallic pretreatments will typically be present on the substrate in a thickness not exceeding about one micron, and usually less, e.g., 0.1 micron or less, and more typically within the range from 0.1 to 0.5 micron. After application of the pretreatment layer it can be subjected to heating prior to undercoating. For example, a nickel strike pretreatment on a ferrous metal substrate might be annealed prior to subsequent undercoating. Other pretreatments of the substrate prior to undercoating, and different from the deposition of a metallic strike or flash coating can be useful. These may include etching of the substrate metal, such as to enhance metallic undercoat adhesion to the substrate.

The metallic undercoating of combined metals in metallic form will most typically be at least one layer of metals in alloy form, although metallic mixtures are also contemplated. Furthermore such undercoating will almost always have at least one layer of a zinc-containing alloy. Such alloy will usually contain from as little as about 30 to 40 weight percent, up to a maximum of about 90 to even about 95 weight percent, of zinc, all basis the metallic undercoating weight. For example, zinc-aluminum alloys and zinc-iron alloys may contain a preponderant amount of the aluminum or the iron, there typically being, on the order of about 55 to about 60 weight percent or more of such aluminum or iron. At elevated zinc amounts, useful zinc-cobalt alloys can be exemplary, some containing as little as 10 weight percent or less of cobalt. Generally the useful alloying metals will include nickel, cobalt, manganese, chromium, tin, copper, aluminum, antimony, magnesium, lead, calcium, beryllium, iron, silicon and titanium. Such metals can be expected to be present in a minimum weight amount of about 0.2–0.5 weight percent or so, it being understood that the alloys may additionally contain elements, including those metals listed above, in trace amounts, e.g., in an amount from less than the about 0.2–0.5 weight percent range down to 0.001 weight percent or less of the alloy.

Specifically useful alloy undercoatings include zinc-iron alloys, which can be dominated in metallic content by either the iron or the zinc, often containing from about 60 down to about 10 weight percent iron. The zinc-aluminum alloys, already mentioned hereinbefore for potentially containing a preponderance of aluminum, can, on the other hand be quite high in zinc. This may particularly be the case when a third alloying metallic element is included, e.g., a zinc-aluminum-magnesium alloy containing a small amount of on the order of about 4 weight percent or so of aluminum with an even more minor amount of several tenths of a weight percent of magnesium. Serviceable zinc-cobalt alloys may include 0.5 to about 20 weight percent cobalt, or the cobalt may serve as a third alloying element in minor amount, such as in a zinc-nickel-cobalt alloy which may contain on the order of about 5 to 30 weight percent of the two alloy elements excluding zinc.

It is to be understood, however, that the useful zinc-containing undercoating alloy may be in combination with up to seven to eight or more of other alloying elements. Particularly preferred undercoatings for economy and enhanced corrosion resistance are the zinc-nickel alloys. These contain zinc in major amount, almost always having nickel present in an amount less than about 25 weight percent and most generally in an amount below about 20 weight percent. On the other hand, as little as about 4 to 6 weight percent may be present so that most typically from about 5–20 weight percent of the nickel is present in the alloy. Such amount of nickel can, in part, depend upon the other elements present, e.g., a minor amount of cobalt as discussed hereinabove, wherein the nickel content of the undercoating will often be more elevated than in the more simplistic zinc-nickel systems. For such preferred undercoatings, the balance will be zinc, it being understood that trace amounts of additional ingredients other than nickel and zinc may be present.

Although the metallic undercoating will most typically be a layer of zinc-containing alloy, other serviceable layers are contemplated. They may be used as one of a layer composite, e.g., as a first layer with a zinc-containing alloy second layer. These other layers include such as are readily commercially available. These are preponderantly iron-containing alloys. Although iron containing alloys are not preferred for best corrosion performance, unless the iron is present as one of several alloying elements, and then also in minor amount, these can nevertheless be useful in composites. For example, the undercoat may consist of first a zinc-iron layer, e.g., an electrodeposited first layer of same, with a preferred zinc-nickel toplayer to form a double layer undercoat of enhanced characteristics. It is usually desirable that the composite have a base layer that is more noble than its covering layer but less noble than the substrate metal, e.g., steel.

The method of applying the undercoating will in general be determined by the economy of application for the particular undercoating selected. For example, with the zinc-iron undercoatings such may be applied by usual zinc application to an iron substrate followed by annealing. On the other hand the preferred zinc-nickel undercoatings may be applied by electrolytic application, including deposition technique relying on subsequent heating for alloying. Electroless deposition of undercoatings is also contemplated. Most typically, regardless of the means of application, the metallic undercoating layer will be present on the metal substrate in an amount of less than about 25 microns thickness. Greater amounts can be uneconomical as well as leading to thick coatings which may be deleteriously brittle. For best economy coupled with highly desirable corrosion resistance, such metallic undercoating layer will advantageously be present in a thickness on the metal substrate of below about 15 microns, and often on the order of about 10 microns or less. On the other hand, undercoats of about 0.1 micron thickness or so are generally insufficient for providing outstanding enhancement in corrosion resistance. Therefore the metallic undercoating will be present in a thickness of at least about 0.2 micron, and more typically in at least about 0.3 micron thickness, such that there will most preferably be present a metallic undercoat layer of from about 0.2 to about 2 microns.

Of particular interest as hexavalent-chromium-containing topcoatings for the present invention are bonding coatings. Those that are preferred may contain succinic acid and other dicarboxylic acids of up to 14 carbon atoms as the reducing agents, as has been disclosed in U.S. Pat. No. 3,382,081. Such acids with the exception of succinic may be used alone, or these acids can be used in mixture or in mixture with other organic substances exemplified by aspartic acid, acrylamide or succinimide. Additionally useful combinations that are particularly contemplated are combinations of mono-, tri- or polycarboxylic acids in combination with additional organic substances as has been taught in U.S. Pat. No. 3,519,501. Also of particular interest are the teachings in regard to reducing agents, that may be acidic in nature, and have been disclosed in U.S. Pat. Nos. 3,535,166 and 3,535,167. Of further particular interest are glycols and glycol-ethers and many representative compounds have been shown in U.S. Pat. No. 3,679,493.

Other compounds may be present in the hexavalent-chromium-containing liquid composition, but, even in combination, are present in very minor amounts so as not to deleteriously affect the coating integrity, e.g., with respect to weldability. Thus, such compositions should contain 0–40 grams per liter of resin, i.e., are substantially resin-free. Since the role of the chromium-providing-substance is partially adhesion, such coating compositions are preferably resin-free. Moreover the total of phosphorous compounds should be minute so as not to deleteriously interfere with coating weldability. Preferably the compositions contain no phosphorous compounds, i.e, are phosphate-free. The other compounds that may be present include inorganic salts and acids as well as organic substances, often typically employed in the metal coating art for imparting some corrosion resistance or enhancement in corrosion resistance for metal surfaces. Such materials include zinc chloride, magnesium chloride, various chromates, e.g., strontium chromate, molybdates, glutamic acid, zinc nitrate, and polyacrylic acid and these are most usually employed in the liquid composition in amount totaling less than about 15 grams per liter.

The preferred topcoatings contain a particulate metallic pigment, preferably a metal such as aluminum, manganese, zinc and magnesium, but which may also include substances such as ferroalloys. The particulate metals have been disclosed as useful in bonding coating compositions containing a hexavalent-chromium-providing substance and reducing agent therefor in liquid medium, such as disclosed in U.S. Pat. No. 3,671,331.

Substantially all of the topcoating compositions are simply water based, ostensibly for economy. But for additional or alternative substances, to supply the liquid medium at least for some of these compositions, there have been taught, as in U.S. Pat. No. 3,437,531, blends of chlorinated hydrocarbons and a tertiary alcohol including tertiary butyl alcohol as well as alcohols other than tertiary butyl alcohol. It would appear then in the selection of the liquid medium that economy is of major importance and thus such medium would most always contain readily commercially available liquids.

Chromium may typically be present in the hexavalent state by incorporation into the topcoating compositions as chromic acid or dichromate salts or the like. During the curing of the applied coatings composition, the metal is susceptible to valency reduction to a lower valence state. Such reduction is generally enhanced by the reducing agent in the composition, when present. For enhanced corrosion resistance the resulting coating will provide at least about 20 percent hexavalent chromium, basis total topcoat chromium, up to about 50 percent of hexavalent chromium. More typically from about 20 to about 40 percent of the topcoating chromium will be in the hexavalent state after curing of the topcoat.

When the topcoating is first established, the applied coating will be non-water resistant. The topcoatings contemplated as useful in the present invention are those which will cure at generally moderate elevated temperature. They can be typically cured by forced heating at such moderately elevated temperature. In general, the curing conditions are temperatures below 550° F. air temperature, and at such temperature, for times of less than about 2 minutes. However, lower temperatures such as 300°–500° F., with curing times, such as 0.5–1.5 minutes are more typically used, with a range of 300°–400° F. being preferred with continuously annealed steels. Hence, the most serviceable topcoats lend themselves to fast and economical overall coating operation, such as will be useful with exemplary steel substrates in strip or coil form.

The resulting weight of the topcoating on the metal substrate may vary to a considerable degree, but will always be present in an amount supplying greater than 10 milligrams per square foot of chromium, measured as chromium and not as $CrO_3$. A lesser amount will not lead to desirably enhanced corrosion resistance. Advantageously, greater than about 15 milligrams per square foot of coated substrate of chromium will be present for best corrosion resistance, while most typically between about 20–500 milligrams per square foot of chromium, always expressed as chromium and not $CrO_3$, will be present. Also, when particulate metal is present the coated metal substrate should contain between about 50 and about 5,000 milligrams per square foot of pulverulent metal and preferably have a weight ratio of chromium to pulverulent metal of not substantially above about 0.5:1.

After coating the resulting coated substrate can be further topcoated with any suitable paint, i.e., a paint, primer, enamel, varnish, or lacquer, although it is preferred not to topcoat. Such paints may contain pigment in a binder or can be unpigmented, e.g., generally cellulose lacquers, rosin varnishes, and oleoresinous varnishes, as for example tung oil varnish. The paints can be solvent reduced or they may be water reduced, e.g., latex or water-soluble resins, including modified or soluble alkyds, or the paints can have reactive solvents such as in the polyesters or polyurethanes. Additional suitable paints which can be used include oil paints, including phenolic resin paints, solvent-reduced alkyds, epoxys, acrylics, vinyl, including polyvinyl butryal and oil-wax-type coatings such as linseed oil-paraffin wax paints. The paints may be applied as mill finishes.

The following examples will serve to further illustrate the operation and advantages of the present invention. The examples should not be considered, however, as a limitation upon the scope of the present invention.

Preparation of Test Parts

Test parts are typically prepared for coating by first immersing in water which has incorporated therein 2 to 5 ounces of cleaning solution per gallon of water. The alkaline cleaning solution is a commerically available material of typically a relatively major amount by weight of sodium hydroxide with a relatively minor weight amount of a water-softening phosphate. The bath is maintained at a temperature of about 120° to 180° F. Thereafter, the test parts are scrubbed with a cleaning pad which is a porous, fibrous pad of synthetic fiber impregnated with an abrasive. After the cleaning treatment, the parts are rinsed with warm water and may be dried.

Application of Coating to Test Parts and Coating Weight

Clean parts are typically coated by dipping into coating composition, removing and draining excess composition therefrom, sometimes with a mild shaking action, and then immediately baking or air drying at room temperature until the coating is dry to the touch and then baking. Baking proceeds in a hot air convection oven at temperatures and with times as specified in the examples.

Coating weights for parts, generally expressed as a weight per unit of surface area, are typically determined by selecting a random sampling of parts of a known surface area and weighing the sample before coating. After the sample has been coated, it is reweighed and the coating weight per selected unit of surface area, most always presented as milligrams per square foot (mg./sq.ft.), is arrived at by straightforward calculation.

Corrosion Resistance Test (ASTM B117-73) and Rating

Corrosion resistance of coated parts is measured by means of the standard salt spray (fog) test for paints and varnishes ASTM B117-73. In this test, the parts are placed in a chamber kept at constant temperature where they are exposed to a fine spray (fog) of a 5 percent salt solution for specified periods of time, rinsed in water and dried.

Prior to placing in the chamber, a portion of the test part is deformed, in the nature of a "dome", by first firmly positioning the part so that the subsequent dome portion corresponds to the circular die of the deforming apparatus. Thereafter, a piston with a ball bearing end is used to deform the portion of the test part through the die into the dome shape. The dome height is 0.30 inch. The extent of corrosion on the test parts is determined by inspecting only the dome and comparing parts one with another, and all by visual inspection.

EXAMPLE 1

There is formulated, with blending, a topcoating composition containing 20 grams per liter of chromic acid, 3.3 grams per liter of succinic acid, 1.7 grams per liter of succinimide, 1.5 grams per liter of xanthan gum hydrophillic colloid, which is a heteropolysaccharide prepared from the bacteria specie *Xanthamonas camperstris* and has a molecular weight in excess 200,000. Additionally, the composition contains 1 milliliter of formalin, 7 grams per liter of zinc oxide, 120 grams per liter of zinc dust having an average particle size of about 5 microns and having all particles finer than about 16 microns, and 1 drop per liter of a wetter which is a nonionic, modified polyethoxide adduct having a viscosity in centipoises at 25° C. of 180 and a density at 25° C. of 8.7 lbs. per gallon. After mixing all of these constituents, this undercoating composition is then ready for coating test panels.

The parts for testing are either cold-rolled steel panels or are commercially available coated steel test panels having an about 0.5 micron thick metallic nickel strike layer on the steel substrate and an about 3 micron thick nickel/zinc alloy undercoating, containing about 15 weight percent nickel, deposited by electrodeposition. The panels are topcoated, by dipping in the above described coating composition, removing and draining the excess composition therefrom. The topcoated panels are then baked up to 3 min. at 500° F. air temperature in a convection oven. The topcoating is judged to be of similar weight on test panels and is measured on the cold-rolled steel test panel to contain 27 mg/sq. ft. chromium, as chromium, and 310 mg/sq. ft. of particulate zinc. Coated panels are subjected to the hereinabove described corrosion resistance test and the results are reported in the table below.

TABLE 1

| Coating On Cold-Rolled Steel | Salt Spray Corrosion On Formed Panels % Red Rust | Hours |
|---|---|---|
| Topcoat | 20% | 96 |
| Nickel/Zinc Alloy Coat | 5% | 96 |
| Nickel/Zinc Alloy Coat & Topcoat | 0% | 1,824 |

EXAMPLE 2

There is formulated, with blending, a topcoating composition containing 40 grams per liter of chromic acid, 40 grams per liter of urea and 0.1 gram of commercial fluorocarbon nonionic surfactant. The parts for testing are either cold-rolled steel panels or are coated steel test panels having an about 0.3–0.4 micron thick metallic nickel strike layer on the steel substrate and an about 3 micron nickel/zinc alloy undercoating, all deposited by electrodeposition. The panels are topcoated, by dipping in the above described coating composition, removing and draining the excess composition therefrom. The topcoated panels are then baked up to 3 min. at 450° F. air temperature in a convection oven. The topcoating is judged to be of similar weight on test panels and is measured on the cold-rolled steel test panel to contain 18 mg/sq. ft. of chromium, as chromium. Coated panels are subjected to the hereinabove described corrosion resistance test and the results are reported in the table below.

TABLE 2

| Coating On Cold-Rolled Steel | Salt Spray Corrosion On Formed Panels Hours to First Red Rust |
|---|---|
| Topcoat | 41 |
| Nickel/Zinc Alloy Coat | 161 |
| Nickel/Zinc Alloy Coat & Topcoat | 1,337 |

What is claimed is:

1. A coated metal substrate having enhanced corrosion resistance and protected by a coating composite comprising a thin metallic undercoating layer of combined metals in metallic form at least one of which is selected from the group consisting of zinc, nickel, iron, chromium, aluminum and cobalt, and a heat-curable, substantially resin free, as well as phosphate free, topcoat layer from composition curable to a water resistance protective coating, said topcoat layer being free from particulate metals while containing above 10 milligrams per square foot of coated metallic undercoating of chromium, as chromium, in non-elemental form, said composition containing hexavalent-chromium-providing-substance in liquid medium.

2. The coated metal substrate of claim 1 wherein said substrate metal is selected from the group consisting of ferrous metal and zinc-, nickel-, cadmium-, cobalt-, and chromium-containing alloys.

3. The coated metal substrate of claim 1 wherein said metallic undercoating layer is in alloy form.

4. The coated metal substrate of claim 3 further characterized by having a zinc-containing alloy as said metallic undercoating layer.

5. The coated metal substrate of claim 4 wherein said metallic undercoating layer is selected from the group consisting of zinc-nickel alloy, zinc-iron alloy, zinc-aluminum alloy, zinc-cobalt alloy, zinc-aluminum-magnesium alloy and zinc-nickel-cobalt alloy.

6. The coated metal substrate of claim 1 further characterized by having less than about 25 microns thickness metallic undercoating layer.

7. The coated metal substrate of claim 1 wherein said metallic undercoating layer is present in an amount below about 15 microns thickness and contains greater than about 40 weight percent zinc.

8. The coated metal substrate of claim 7 wherein said metallic undercoating layer is present in an amount from about 0.2 to about 2 microns thickness.

9. The coated metal substrate of claim 1 wherein said substrate metal is ferrous metal, said ferrous metal is coated with a metallic pretreatment selected from the group consisting of nickel, cobalt, tin, copper and their mixtures where such exist and said metallic undercoating layer coats said pretreatment.

10. The coated metal substrate of claim 9 wherein said metallic pretreatment is present on the order of about one micron thickness or less.

11. The coated metal substrate of claim 1 wherein said water resistant topcoat layer contains more than about 15 milligrams per square foot of coated metallic undercoating of said chromium in non-elemental form and is established from aqueous-based, heat-curable, composition.

12. The coated metal substrate of claim 11 further characterized by said water resistant topcoat layer containing from about 20 to about 500 milligrams per square foot of coated metallic undercoating of said chromium in non-elemental form.

13. The coated metal substrate of claim 1 wherein said water resistant topcoat layer contains more than about 20 weight percent of said chromium, basis total topcoat chromium, as hexavalent chromium.

14. The coated metal substrate of claim 13 further characterized by having a water resistant topcoat layer containing more than about 20 weight percent but less than about 50 weight percent of said chromium in hexavalent form.

15. The coated metal substrate of claim 1 wherein said water resistant topcoat layer is further coated.

16. A coated metal substrate having enhanced corrosion resistance and protected by a coating composite comprising a thin metallic undercoating layer containing zinc and nickel in alloy form and a heat curable, substantially resin free, as well as phosphate free, topcoat layer from composition curable to a water resistant protective coating, said topcoat layer being free from particulate metals while containing above 10 milligrams per square foot of coated metallic undercoating of chromium, as chromium, said composition containing hexavalent-chromium-providing-substance in liquid medium.

17. The coated metal substrate of claim 16 wherein said substrate metal is selected from the group consisting of ferrous metal and zinc-, nickel-, cadmium-, cobalt-, and chromium-containing alloys.

18. The coated metal substrate of claim 16 wherein said metallic undercoating layer is an electrodeposited alloy coating.

19. The coated metal substrate of claim 16 wherein said metallic undercoating layer is selected from the group consisting of zinc-nickel alloy and zinc-nickel-cobalt alloy.

20. The coated metal substrate of claim 16 further characterized by having less than about 25 microns thickness of zinc-nickel alloy undercoating layer.

21. The coated metal substrate of claim 20 further characterized by having from about 0.2 to about 2 microns thickness of zinc-nickel alloy undercoating layer.

22. The coated metal substrate of claim 16 wherein the metals present in said metallic undercoating layer in other than trace amounts, are less than about 25 weight percent nickel and a balance of zinc.

23. The coated metal substrate of claim 22 wherein the metals of said metallic undercoating layer in greater than trace amounts are from about 5 to about 20 weight percent nickel and a balance of zinc.

24. The coated metal substrate of claim 16 wherein said substrate metal is ferrous metal, said ferrous metal is coated with a metallic nickel pretreatment and said metallic undercoating layer coats said nickel pretreatment.

25. The coated metal substrate of claim 24 wherein said metallic nickel pretreatment is present on the order of about one micron thickness or less.

26. The coated metal substrate of claim 16 wherein said water resistant topcoat layer contains more than about 15 milligrams per square foot of coated metallic undercoating of chromium in non-elemental form and is established from aqueous-based, heat-curable composition.

27. The coated metal substrate of claim 26 wherein said water resistant topcoating layer contains from about 20 to about 500 milligrams per square foot of coated metallic undercoating of said chromium in non-elemental form.

28. The coated metal substrate of claim 16 wherein said water resistant topcoat layer contains more than about 20 weight percent of said chromium, basis total topcoat chromium, as hexavalent chromium.

29. The coated metal substrate of claim 28 wherein said water resistant topcoat layer contains more than about 20 weight percent but less than about 50 weight percent of said chromium in hexavalent form.

30. The coated metal substrate of claim 16 wherein said water resistant topcoat layer is further coated.

31. A coated metal article in sheet form having on one or both faces of said formed article a thin metallic undercoating layer of combined metals in metallic form at least one of which is selected from the group consisting of zinc, nickel, iron, chromium, aluminum and cobalt, while further having on one or both faces of said formed article a heat curable, substantially resin free, as well as phosphate free, topcoat layer from composition curable to a water resistant protective coating, said topcoat layer being free from particulate metals while containing about 10 milligrams per square foot of coated metallic undercoating of chromium, as chromium, in non-elemental form, said composition containing hexavalent-chromium-providing-substance in liquid medium.

32. The coated metal article of claim 31 further characterized by being a coated steel sheet in coil form.

33. The coated metal article of claim 31 wherein said metallic undercoating is an electrodeposited zinc and nickel alloy coating and said topcoating contains more than about 15 milligrams per square foot of coated substrate of chromium, as chromium, in non-elemental form.

* * * * *